US005484116A

United States Patent [19]

Horak et al.

[11] Patent Number: 5,484,116

[45] Date of Patent: Jan. 16, 1996

[54] METHOD AND APPARATUS FOR MOVING INDIVIDUAL YARN ENDS INTO A YARN END JOINING DEVICE

[75] Inventors: Dieter Horak; Uwe Fabelje; Joachim Stiller; Dietmar Engelhardt, all of Monchen-Gladbach; Norbert Corres, Wassenberg; Petra Vautz, Monchen-Gladbach; Arnold Muck, Schwalmtal; Ulrich Wirtz, Monchen-Gladbach, all of Germany

[73] Assignee: W. Schlafhorst AG & Co., Moenchengladbach, Germany

[21] Appl. No.: 126,488

[22] Filed: Sep. 24, 1993

[30] Foreign Application Priority Data

Sep. 24, 1992 [DE] Germany ..... 42 31 958.7

[51] Int. Cl.[6] ..... B65H 54/20; B65H 54/22

[52] U.S. Cl. ..... 242/35.6 R; 57/22; 57/261; 242/35.6 R; 242/37 A

[58] Field of Search ..... 242/35.6 R, 35.6 E, 242/37 A; 57/22, 261, 262

[56] References Cited

U.S. PATENT DOCUMENTS

| | | | |
|---|---|---|---|
| 4,263,775 | 4/1981 | Mima | 57/22 |
| 4,535,945 | 8/1985 | Rohner et al. | 242/35.6 R |
| 4,569,543 | 2/1986 | Kohlen et al. | 289/2 |
| 4,893,461 | 1/1990 | Artzt et al. | 57/261 |
| 4,922,704 | 5/1990 | Slavik et al. | 57/261 |
| 4,944,145 | 7/1990 | Stahlecker | 57/261 |
| 5,090,635 | 2/1992 | Grecksch | 242/35.6 R |
| 5,313,775 | 5/1994 | Binder et al. | 57/261 |

FOREIGN PATENT DOCUMENTS

| | | | |
|---|---|---|---|
| 3225379 | 1/1984 | Germany . | |
| 3339331 | 5/1985 | Germany . | |
| 3624904 | 1/1988 | Germany | 242/37 A |

*Primary Examiner*—William Stryjewski
*Attorney, Agent, or Firm*—Shefte, Pinckney & Sawyer

[57] ABSTRACT

A method and apparatus for moving individual yarn ends into a yarn disposition at a yarn end joining device in a winding station of a bobbin winding machine includes moving individual in succession a yarn end from a delivery bobbin to the yarn end joining device, and a yarn end from a take-up bobbin to the yarn end joining device by a single yarn manipulator device.

15 Claims, 9 Drawing Sheets

METHOD AND APPARATUS FOR MOVING INDIVIDUAL YARN ENDS INTO A YARN END JOINING DEVICE

BACKGROUND OF THE INVENTION

The present invention relates broadly to methods and apparatus or manipulating yarn end in a bobbin winding machine and, more particularly, to a method and apparatus for moving individual yarn ends into a yarn receiving disposition at a yarn end joining device in a winding station of a bobbin winding machine in the absence of proper yarn travel from a delivery bobbin to a take up bobbin. Specifically, a yarn end from the delivery bobbin is first placed in the yarn end joining device as a downstream yarn and a yarn end of the take-up bobbin is then placed in the yarn end joining device as an upstream yarn, and the yarn ends are subsequently joined together by the yarn end joining device.

Currently, at the winding stations of bobbin winders, if a yarn break occurs or if a delivery bobbin or take-up bobbin is changed, a yarn end from the incoming bobbin is spliced automatically with the yarn end from the remaining bobbin. To that end, the yarn end on the delivery bobbin and the yarn end on the take-up bobbin are automatically grasped and placed in a yarn end joining device, where the two yarn ends are either knotted together or spliced.

The tasks of searching for the yarn ends, placing them in the yarn end joining device and joining the yarn ends are done either by a movable device that moves from one winding station to another or by auxiliary devices that are permanently installed at the winding stations.

Yarn manipulating suction tubes are one known auxiliary device for placing the yarn ends in the yarn end joining device. U.S. Pat. No. 4,263,775 to Mima discloses grasping yarn coming from the delivery bobbin and placing it in the yarn end joining device by means of a pivotable suction tube that is connected directly to a negative pressure source. Another suction nozzle, which is also connected to a negative pressure source, seeks the yarn end that has run up onto the take-up bobbin, engages it, and moves it to the yarn end joining device for joining the two yarn ends. According to Mima, a separate suction tube is provided for each yarn end. Movement of the suction tubes is coordinated so that the placement of the yarn ends in the yarn end joining device will occur in proper sequence. This type of device requires a commensurate amount of space at the winding station as well as suitable controls for coordinating the movement of the two suction tubes.

SUMMARY OF THE INVENTION

It is accordingly an object of the present invention to provide an apparatus and method for moving yarn ends into a yarn end joining device for subsequent joining thereof which addresses the above-defined concerns. More specifically, it is an object of the present invention to provide a method and apparatus for moving individual yarn ends into a yarn receiving disposition for subsequent joining thereof using a single manipulator device.

According to the preferred embodiment of the present invention a method for moving individual yarn ends into a yarn receiving disposition at a yarn end joining device for use in a winding station of a bobbin winding machine having at least one delivery bobbin having a yarn end, at least one take-up bobbin also having a yarn end and a yarn joining device, comprises the steps of providing a common arrangement for moving the yarn ends, moving a first one of the yarn ends into yarn receiving disposition at the yarn joining device using the yarn moving arrangement and moving a second one of the yarn ends into yarn receiving disposition at the yarn joining device using the yarn moving arrangement after the first yarn end is disposed at the yarn joining device.

Preferably, the yarn travels from the delivery bobbin to the take-up bobbin in a predetermined yarn travel direction and the step of moving a first yarn end includes moving a yarn end from the delivery bobbin to the yarn end joining device at a first predetermined yarn receiving disposition and the step of moving a second yarn end includes moving a yarn end from the take-up bobbin to the yarn end joining device at a second predetermined yarn receiving disposition, the first predetermined disposition being downstream of the second predetermined disposition with respect to the yarn travel direction. It is preferred that the winding machine include a yarn clamping and severing assembly and the yarn moving arrangement is movably mounted to the winding station for movement between an initial position and a final position. Further, the yarn moving arrangement may include a suction arrangement for engaging and retaining the yarn ends for controlled movement and positioning thereof.

It is further preferred that the steps of moving the first and second yarn ends further include the steps of engaging the delivery bobbin yarn end with the moving arrangement at an initial position of the moving arrangement, moving the moving arrangement to place the delivery bobbin yarn end into the yarn end joining device, clamping the delivery bobbin yarn end upstream of the yarn end joining device, and severing the yarn upstream from the clamping assembly before returning arrangement to its initial position, engaging the take-up bobbin yarn end, moving the yarn moving arrangement toward its initial position, and, during movement of the yarn moving arrangement toward its initial position, placing the take-up bobbin yarn end into the yarn end joining device. Preferably, the method further includes the step of removing the severed portion of the delivery bobbin yarn end by suction aspiration of the severed yarn position.

It is preferred that the steps of moving the yarn ends include suctioning the yarn end from the delivery bobbin and suctioning the yarn end from the take-up bobbin separately in succession by the suction arrangement. The step of moving a first yarn end includes sensing the presence of a yarn end within the yarn moving arrangement until the first yarn end is disposed in a yarn receiving disposition at the yarn end joining device, and the step of moving a second yarn end includes sensing the presence of a yarn end within the yarn moving arrangement until the second yarn end is disposed in yarn receiving disposition at the yarn end joining device.

According to the preferred embodiment of the apparatus of the present invention, an apparatus for use in a winding station of a bobbin winding machine having at least one delivery bobbin having a yarn end, at least one take-up bobbin having a yarn end and a yarn joining device, for moving the individual yarn ends into a yarn receiving disposition in the yarn joining device for subsequent joining thereof, includes a common arrangement for moving a first one of the yarn ends into yarn receiving disposition at the yarn joining device and, then moving a second one of the yarn ends into yarn receiving disposition at the yarn joining device. Preferably, the yarn moving arrangement includes a yarn manipulating device having a pivotably mounted portion and including an arrangement for applying suction for aspiration of the yarn ends. It is preferred that the yarn manipulating device include a suction nozzle pivotably mounted at one end for movement through a yarn travel path defining a yarn engagement region.

Preferably, the apparatus further includes a second suction nozzle disposed adjacent the take-up bobbin for aspiration of a yarn end from the take-up bobbin, the nozzle of the yarn manipulating device nozzle and said second nozzle being cooperatively arranged for transfer of the take-up bobbin yarn end from the second nozzle to the yarn manipulating device nozzle for aspiration and subsequent movement thereby to the yarn joining device. Preferably, the suction nozzle is pivotable through a plane through which the yarn travels, and the second nozzle includes a generally flat opening disposed adjacent the circumferential face of the take-up bobbin and includes a connection neck disposed at its opposite end for cooperative engagement with the suction nozzle for suction aspiration of the take-up bobbin yarn end. The apparatus further includes an arrangement for sensing the presence of a yarn end in the yarn manipulating device which is disposed in the suction arrangement for detecting the presence of an aspirated yarn end.

Preferably, the yarn travels from the delivery bobbin to the take-up bobbin in a predetermined yarn travel direction along the yarn transfer path. The winding machine preferably includes an arrangement for clamping and severing yarn disposed upstream of the yarn end joining device, the clamping and severing arrangement being actuable independently of the yarn end joining device. The apparatus further includes an assembly for driving the suction nozzle of the yarn manipulating device through the yarn transfer path and a control arrangement for selectively controlling the operation of the drive arrangement. The suction nozzle of the yarn manipulating device is movable in the yarn transfer path between an initial position upstream of the delivery bobbin beyond the yarn travel path to a final position adjacent the second nozzle. It is further preferred that the control arrangement is operative to move the suction nozzle from its initial position to a first yarn receiving position for aspiration of the yarn end from the delivery bobbin, therefrom to a second position adjacent the yarn end joining device for placement of the delivery tube yarn end into the yarn end joining device therefrom to a third yarn receiving position at the second nozzle for aspiration of the yarn end from the take-up bobbin, and therefrom to the initial position of the suction nozzle for placement of the take-up bobbin yarn end into the yarn end joining device for subsequent joining of the yarn ends by the yarn end joining device. The control arrangement is further operative to actuate the clamping and severing arrangement for clamping and severing the delivery bobbin yarn end after movement of the suction nozzle of the yarn manipulating device from its initial position to its second position.

It is preferred that the second nozzle include a slot for passage therethrough of a yarn end from the take-up bobbin upon placement of the yarn en in the yarn end joining device, the slot being disposed adjacent the take-up bobbin. Further, the second nozzle is pivotably mounted for movement toward and away from the take-up bobbin and the apparatus further includes an arrangement for so moving the second nozzle and an arrangement for controlling the second nozzle movement. The arrangement for controlling movement of the second nozzle is operatively connected to the yarn sensing arrangement to activate the arrangement for moving the second nozzle in response to the sensing arrangement indicating the absence of a yarn end in the yarn end manipulating device.

The diameter of the take-up bobbin varies according to the amount of yarn wound thereon and it is desired that a predetermined spacing be maintained between the second nozzle and the outer surface of the take-up bobbin. Therefore, it is preferred that the apparatus further include an arrangement for determining the instantaneous diameter of the take-up bobbin which is operatively connected to the second nozzle control arrangement for initiating movement of the second nozzle responsive to changes in diameter of the take-up bobbin for maintaining the predetermined spacing.

By the above, the present invention provides a method and apparatus for moving individual yarn ends in succession from, first, a delivery bobbin and, second, a take-up bobbin into yarn joining engagement at a yarn-joining device using a single yarn manipulating device. Therefore, the present invention provides space, resource and energy savings over the present state of the art.

DESCRIPTION OF THE PREFERRED EMBODIMENT

Figure 1:
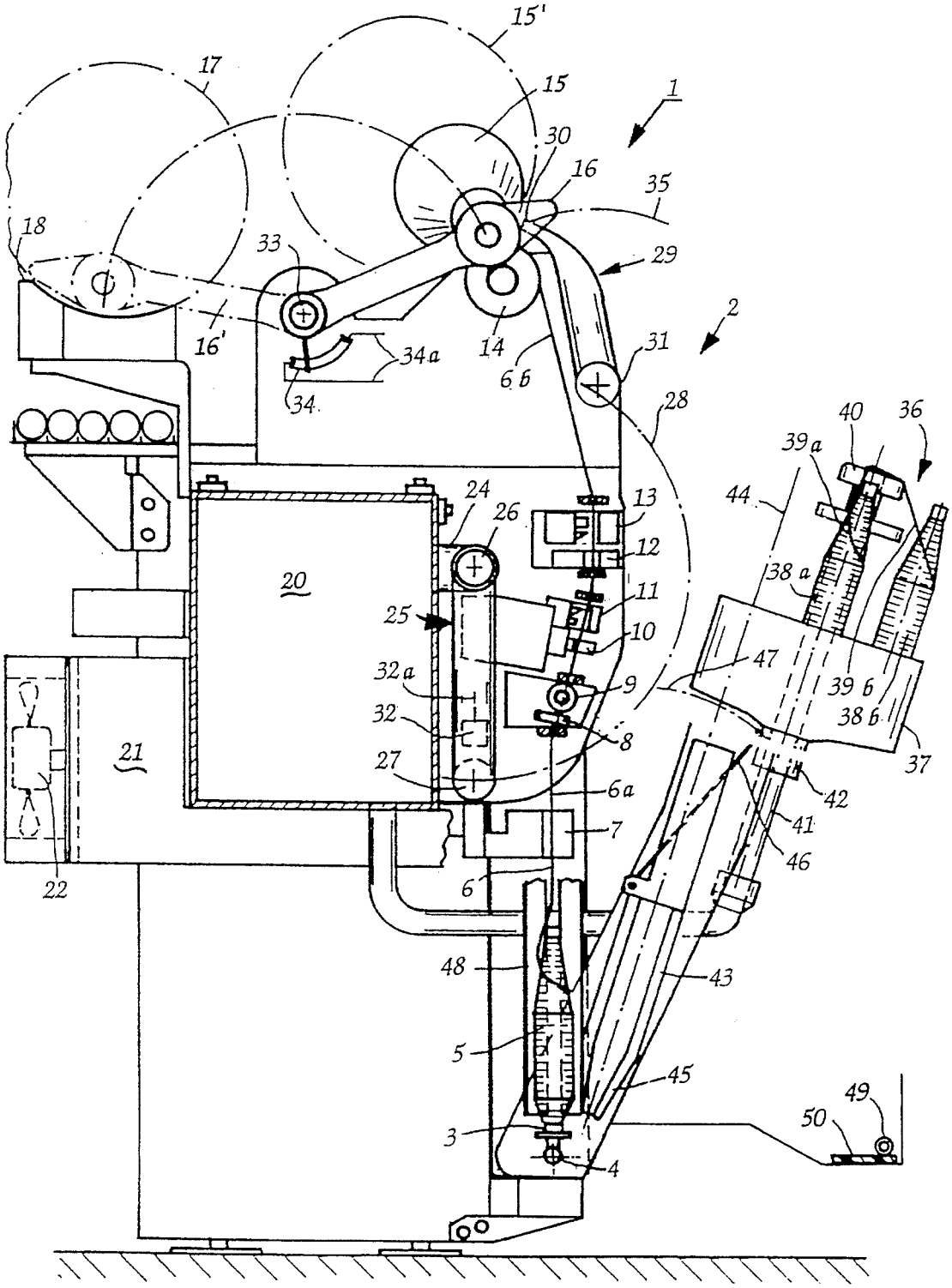
FIG. 1 is a sectional view of a bobbin winding machine at a winding station illustrating the yarn moving apparatus according to the preferred embodiment of the present invention.

Turning now to the accompanying drawings, and more particularly to FIG. 1, a bobbin winding machine 1 is illustrated generally and includes a winding station 2. As bobbin winding machines are generally known, only the characteristics required to understand the present invention are shown and described.

With continued reference to FIG. 1, a delivery bobbin 5 is shown in the unwinding position disposed on the spindle 3 of a pallet-type tube support member, which is pivotably supported about a joint 4 in order to receive a delivery bobbin 5. A yarn strand 6 is illustrated in FIG. 1 being drawn from the delivery bobbin 5. An unwinding accelerator 7 is disposed above the delivery bobbin 5. From the delivery bobbin 5, the yarn 6 travels through a yarn transfer path in a predetermined yarn travel direction to a take-up bobbin 15. The yarn strand 6 travels through a precleaner 8, a yarn tension device 9 and, therefrom, through a yarn end joining device 10. A yarn severing and clamping device 11 is disposed adjacent the yarn end joining device 10 upstream thereof with respect to the direction of yarn travel. It should be noted that the yarn severing and clamping device 11 may be integral with the yarn end joining device 10, provided that the severing and clamping device be actuable independently of the yarn end joining device 10. From there, the yarn strand 6 then travels through an electronic cleaner 12, for detecting yarn flaws, and an additional severing and clamping device 13 disposed upstream of the electronic cleaner 12. The second severing and clamping device 13 is operatively connected to the electronic cleaner 12. The yarn strand 6 is then deposited by a winding drum 14 in cross wound layers on a take-up bobbin 15 which may be a conical cross wound bobbin. The take-up bobbin 15 is held by a creel 16 and rests with its circumference on the winding drum 14 by which it is also driven. A fully wound take-up bobbin 15' is illustrated in dotted lines which is shown movable between a winding position and a discharge position. A fully wound take-up bobbin 17 disposed on a transport device 18 is illustrated also in dotted lines. The transport device 18 is disposed on the back of the bobbin winder 1 and moves along between winding stations.

A central suction conduit 20 extends lengthwise through the bobbin winder 1 and is illustrated in cross-section in FIG. 1. The end of the suction conduit 20 opens into a separator chamber 21 which is disposed at the end of the bobbin winder 1 and in which dust and yarn waste is removed. A fan 22 is illustrated adjacent the separator chamber 21 and is provided as a negative pressure source for the central suction conduit 20 and the separator chamber 21.

Figure 8:
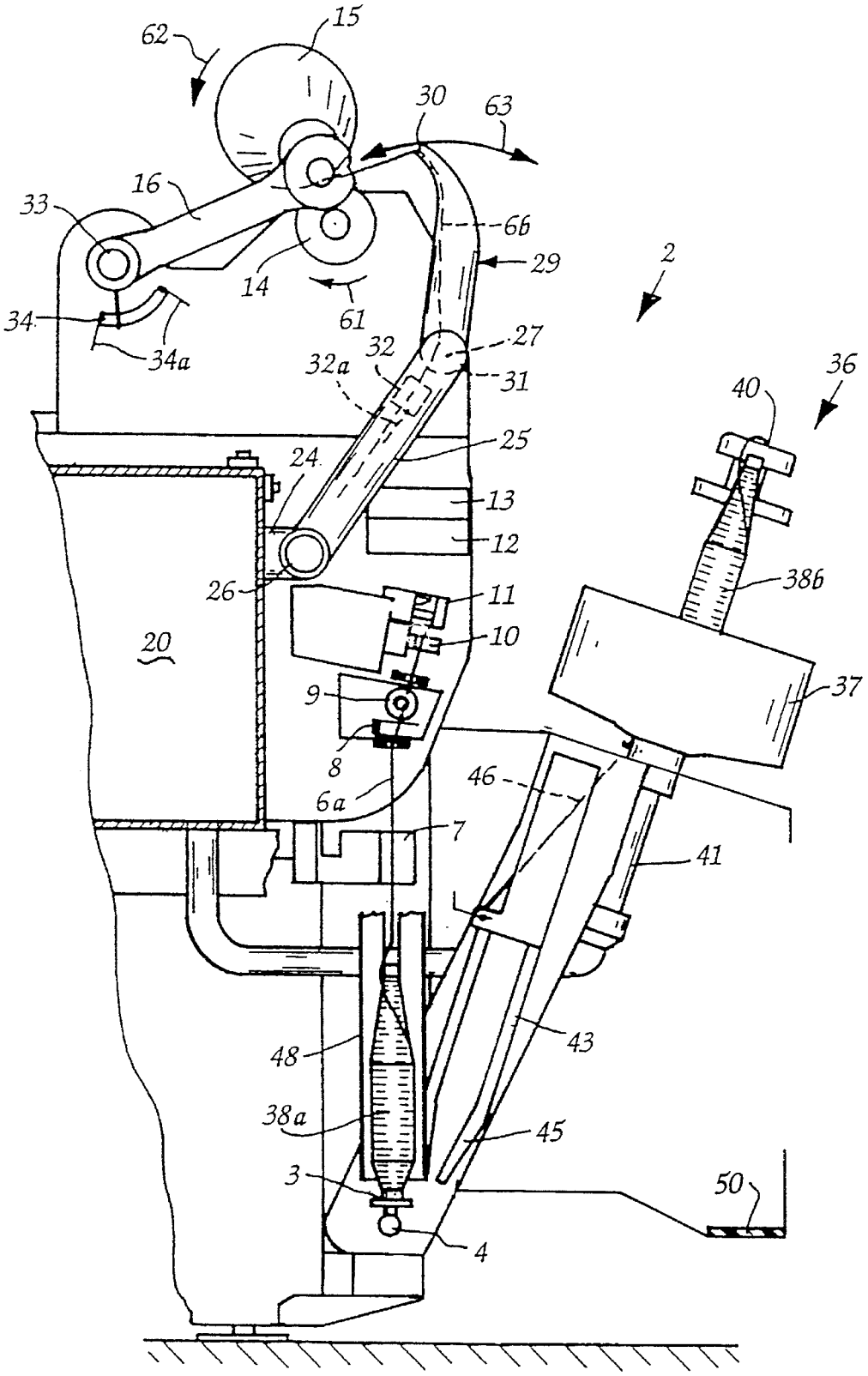
FIG. 8 is a side view of the winding station illustrated in FIG. 7 snowing movement of the second nozzle.
Figure 9:
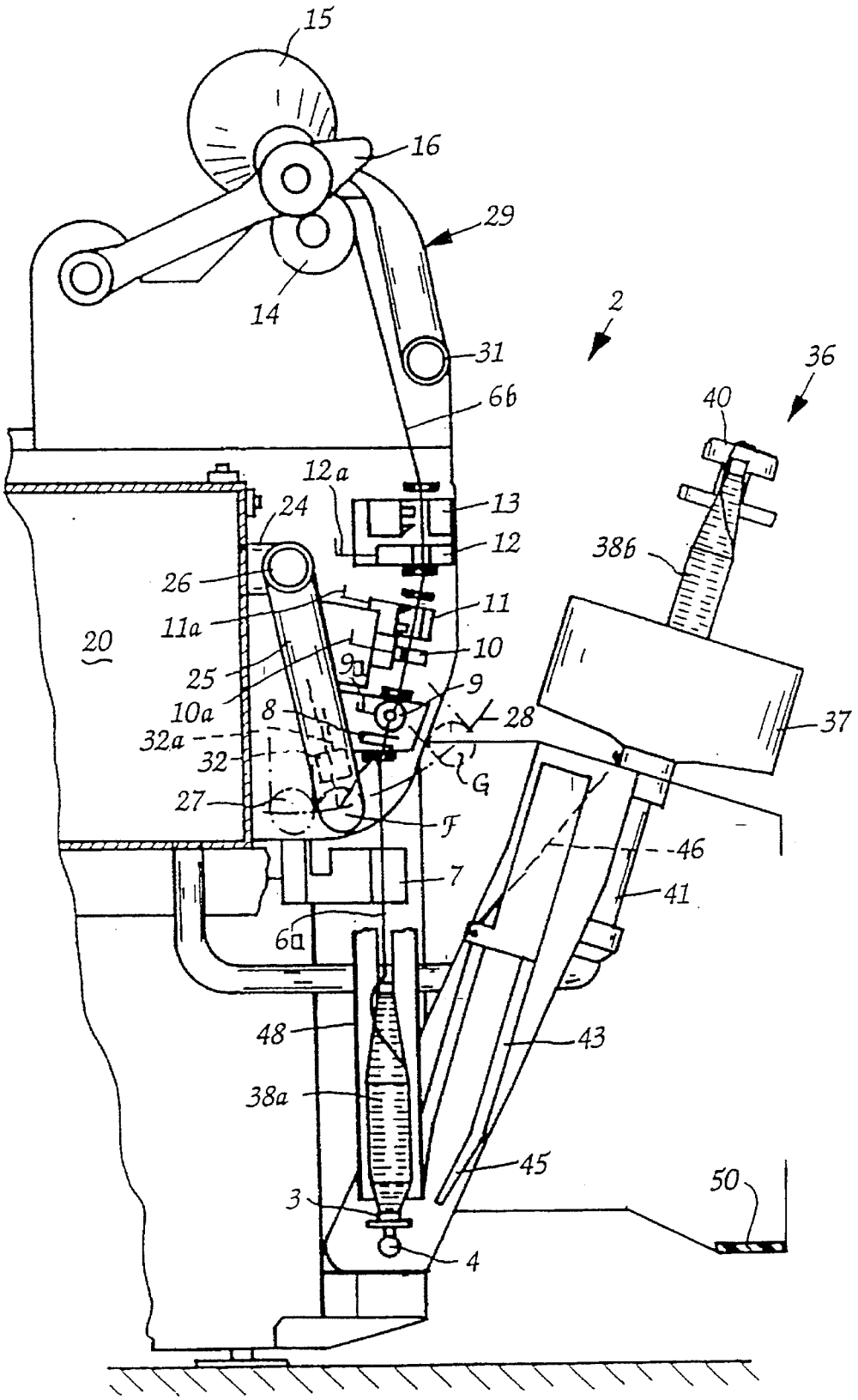
FIG. 9 is a side view of the yarn winding station illustrating movement of the yarn end from the take-up bobbin into a yarn joining disposition at the yarn end joining device.

A yarn manipulating device, formed as a cylindrical suction tube, open at both ends and configured as a shallow U-shaped structure, according to the present invention, is pivotably mounted to the bobbin winding machine 1 adjacent the suction conduit 20 and is in pneumatic communication therewith such that suction applied to the suction conduit is felt within the yarn manipulating device 25. The yarn manipulating device 25 is rotatably supported about its connection 24 at a rotary joint 26. The distal end of the yarn manipulating device 25 includes a suction nozzle 27 oriented vertically to the plane of yarn travel. The yarn manipulating device 25 is pivotable between an initial position as illustrated in FIG. 1 and a final position as best seen in FIG. 8 through an arc 28 which, when combined with the yarn travel path defines a yarn engagement region.

The yarn manipulating device 25 of the present invention performs several functions. Initially, it engages a portion 6a of the yarn strand 6 which is disposed downstream of the yarn joining device 10 after a yarn break. The yarn 6*a* so engaged is moved to the yarn end joining device by the yarn manipulating device 25. Further, after a change of delivery bobbins 5, the yarn manipulating device 25 engages the yarn held ready on a new delivery bobbin and moves it to the yarn end joining device 10 for engagement thereby. This movement occurs along the arc 28 of movement of the yarn manipulating device 25. A second, generally flat nozzle 29, having an opening 30,is provided for operative engagement by the yarn manipulating device 25 and is pivotably mounted to the bobbin winding machine 1 adjacent the take-up bobbin 15. The nozzle opening 30 is disposed above the winding drum 14 opposite the circumferential face of a take-up bobbin 15. The second nozzle 29 terminates in a connection neck 31. After the transfer of the delivery bobbin yarn strand 6*a*, the suction nozzle 27 of the yarn manipulating device 25 pivots to a position adjacent the connector 31 for engaging the yarn end 6*b* of the take-up bobbin 15 for moving the take-up bobbin yarn end 6*b* to a position for engagement with the yarn end joining device 10. A sensor 32 is disposed internally within the yarn manipulating device 25 for detection of the presence or absence of a yarn end. Depending on the disposition of a yarn end, motions of the yarn manipulating device 25 are controlled.

Figure 2:
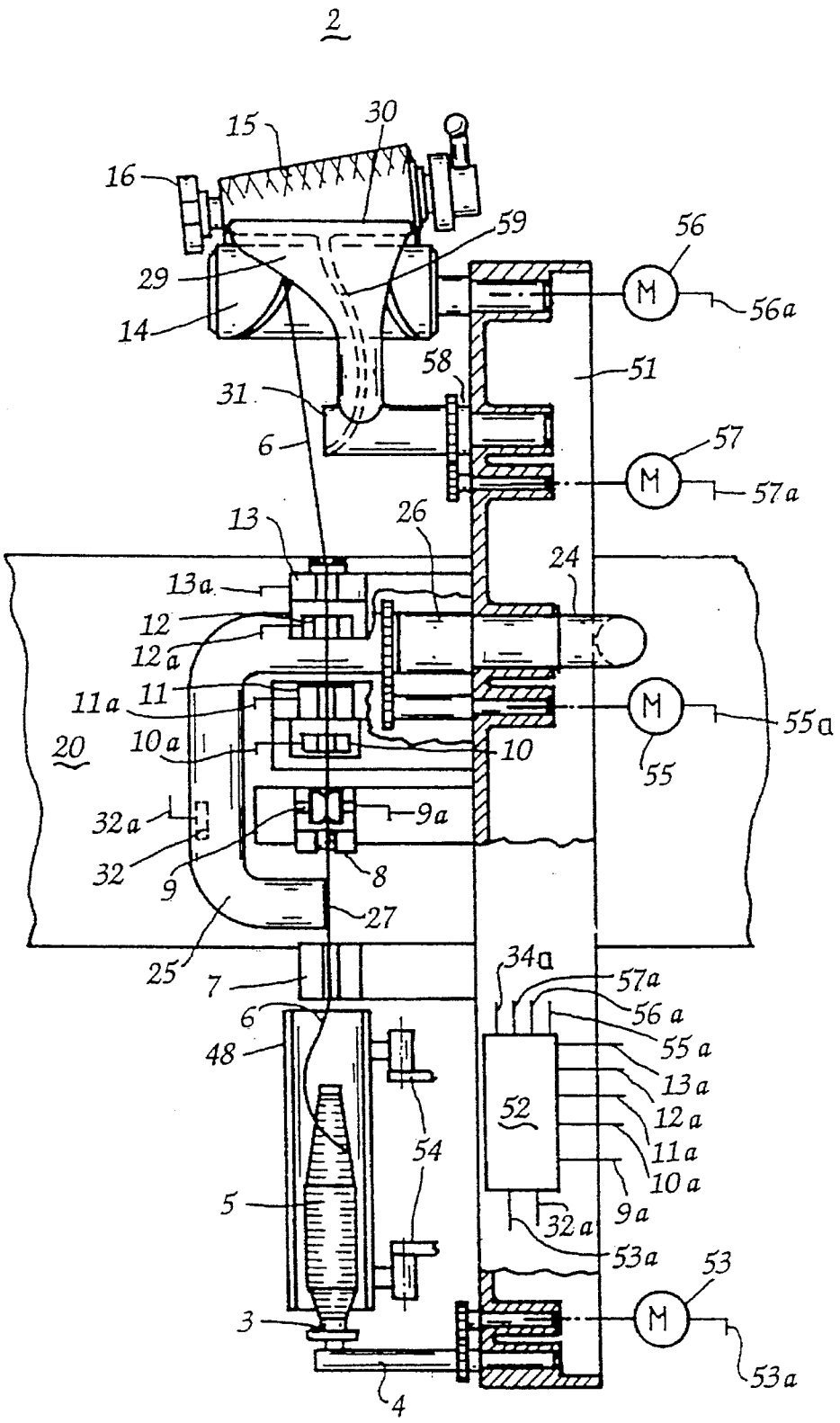
FIG. 2 is a front view of the winding station illustrated in FIG. 1.

During the process of winding the take-up bobbin 15, the opening 30 to the second nozzle 29 is disposed adjacent the circumferential face of the yarn package on the take-up bobbin 15. As the take-up bobbin 15 accepts more yarn during the winding process, the diameter of the yarn package increases, increasing the likelihood that the yarn package will abut the opening 30 of the second nozzle 29. Accordingly, the second nozzle 29 is pivotably mounted to an extension of the connector neck 31 which is mounted in the machine frame in a disposition for engagement with the yarn manipulating device 25. The second nozzle 29 may then be pivotably moved inwardly and outwardly, toward and away from the yarn package, as best seen in FIGS. 1 and 2. The inward and outward deflecting motion of the second nozzle 29 is controlled responsive to motion of the creel 16. At the pivot point 33 of the creel 16, a sensor 34 is disposed to sense the swiveling motion of the creel 16 and, as a function thereof, controls the deflecting motion of the opening 30 of the second nozzle 29 through a second nozzle arc 35 illustrated in FIG. 1.

In order to maintain rapid yarn winding operations, a bobbin changer device 36 having a bobbin magazine 37 is disposed adjacent the winding station 2 for delivery of incoming bobbins for unwinding. Devices of this type are generally known and only the essential features of this device necessary for understanding the invention are herein shogun and discussed.

With reference to FIG. 1, delivery bobbins 38*a* and 38*b* are illustrated disposed within the magazine 37 in preparation for reloading the winding station 2. A suction tube 41 is disposed within the magazine and is in pneumatic communication with the central suction conduit 20. A suction nozzle 40 is disposed on the distal end of the suction tube 41 and is used for retaining yarn ends 39*a*,39*b* of the reserve bobbins 38*a*,38*b*, respectively. The magazine 37 itself is a generally hollow cylinder having a wall formed at one end and the other end open and projecting outwardly for insertion of reserve bobbins thereinto. The magazine 37 rotates about the suction tube 41 on bearings 42 for selective positioning of reserve bobbins in a bobbin replacement disposition. A bobbin chute 43 is disposed beneath the magazine 37 for directing bobbins downwardly onto the spindle 3 for unwinding. As a reserve bobbin drops down the chute 43, alignment flaps 45 direct the bobbin onto the spindle 3 which has been pivoted into a bobbin receiving orientation in alignment with the chute 43. A yarn transfer member 46 is pivotably mounted along the chute and movable through an arc 47 for moving the yarn ends from the reserve bobbins into the yarn engagement region of the nozzle 27 on the yarn manipulating device 25.

When the reserve bobbin is mounted to the spindle 3 it is pivoted into an unwinding position wherein it is surrounded by a so-called blower bottle 48. Should a yarn break occur, the yarn end is blown upwardly into the yarn engagement region of the suction nozzle 27 by air traveling through the blower bottle 48. Once bobbin tubes have become empty, they are ejected from the winding position and travel over a conveyor belt 50 for empty tubes 49 that extends along the front of the bobbin winder 1.

Motions of the various pivoting arms, yarn processing devices, and bobbin moving devices are controlled by a central control unit 52 as seen in FIG. 2. The control unit 52 accepts data from various control lines 9*a*, 10*a*, 11*a*, 12*a*, 13*a*, 32*a*, 34*a*, 53*a*, 55*a*, 56*a*, and 57*a*, for controlling various functions of the winding station 2. For example, pivoting movement of the spindle 3 is provided by a drive shaft 4 connected to a motor 53 which is controlled through line 53*a* by the control unit 52. Movement of the yarn manipulating device 25 is caused by a motor 55, the motor being controlled through line 55*a* by the central control unit 52. Movement of the second nozzle 29 is a motor 57 which is controlled through line 57*a* by the central control unit 52. Movement of the winding drum 14 is caused by a motor 56 which is controlled through control line 56*a* by the central control unit 52. Other devices associated with the winding station 2 including the yarn tensioning device, the yarn end joining device 10, the yarn cutting device 11, the electronic cleaner 12, and another yarn cutting device 13 are all controlled by the central control device 52 via control lines 9*a*, 10*a*, 11*a*, 12*a* and 13*a*, respectively. The yarn sensor 32, disposed within the yarn manipulator tube 25 is controlled by the central control unit 52 using a signal line 32*a*. Once the sensor 32 detects a yarn end, the control unit 52 engages the yarn manipulator device motor 55 using the signal line 55*a* to pivot the yarn manipulator device 25 about its mount 26 into a position required for yarn transfer.

With reference to FIGS. 1 and 2, when the electronic cleaner 12 detects a yarn end 6*a*, it signals the central control unit 52 using signal line 12*a*. As a result, the central control unit 52 activates the severing and clamping device 11 disposed immediately upstream of the yarn end joining device 10, using signal line 11*a*. To enable placing the yarn in the yarn tension device 9, the yarn tension device 9 is opened by the central control device using signal line 9*a*.

Figure 7:
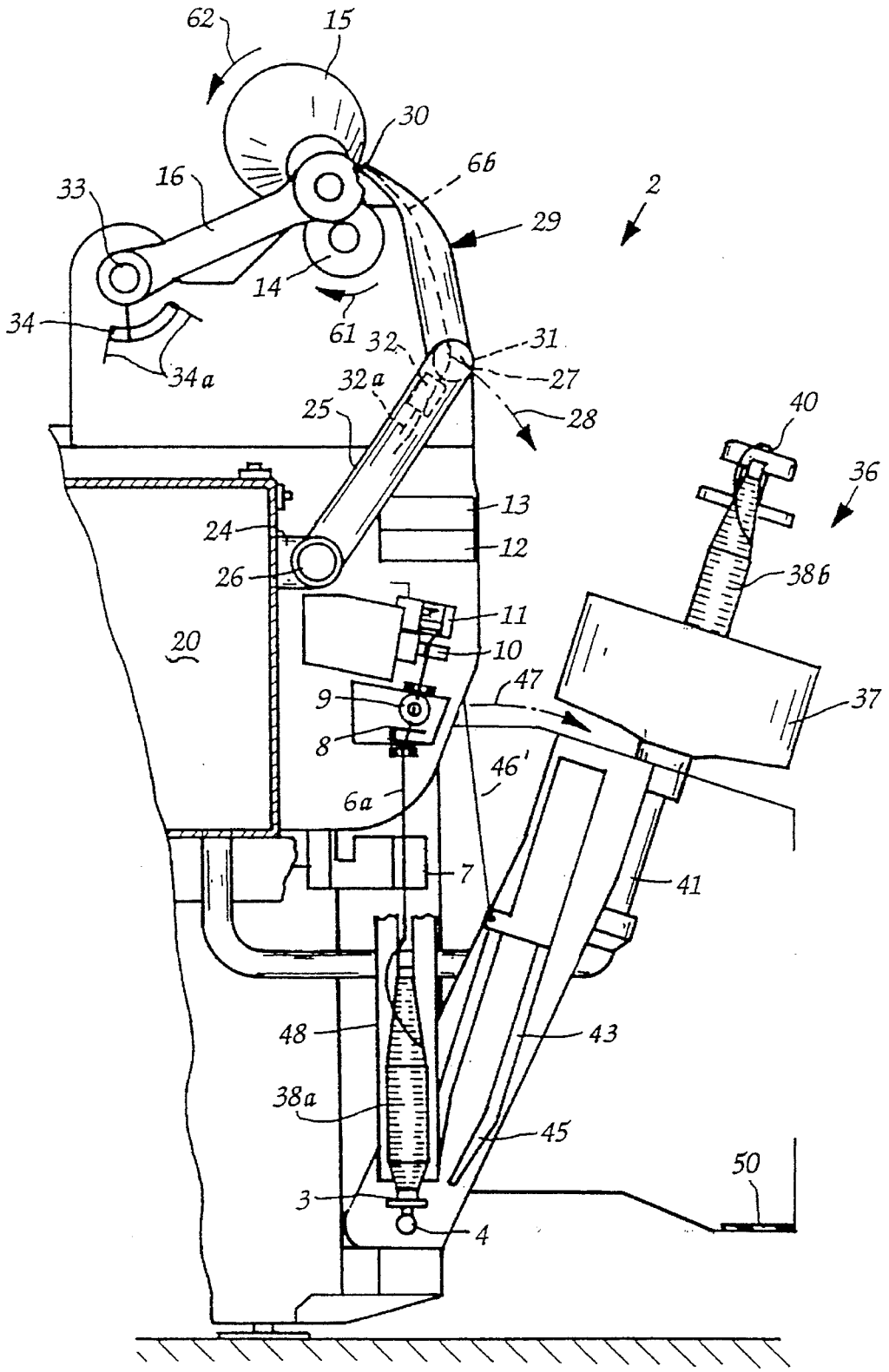
FIG. 7 is a side view of the winding station of FIG. 6 showing the delivery tube yarn end in the yarn end joining device with the yarn manipulating device engaging a yarn end from the take-up bobbin.

With reference to FIGS. 2 and 7, once the yarn manipulating tube 25 has pivoted with its nozzle 27 in front of the opening 30 to the connector neck 31 of the second nozzle 29, a yarn end is removed from the take-up bobbin 15, suctioned from the second nozzle 29. Accordingly, the drive motor 56 of the winding drum 14 is then activated by the central control device 52 through line 56*a* such that the winding drum 14 is driven to rotate the take-up bobbin 15 in an unwinding direction. If, after a predetermined period of time, the sensor 32 disposed within the yarn manipulating device 25 senses no yarn present then the drive motor 57 controlling movement of the second nozzle 29 is activated by the central control device using signal line 57*a* causing the second nozzle 29 to reciprocate toward and away from the take-up bobbin 15 in search of a yarn end. Once a yarn end is detected within the yarn end manipulating device 25, then the central control unit 52 activates the yarn manipulating device drive motor 55 through signal line 55*a* to move the acquired yarn end toward the yarn end joining device 10 which is then activated by the central control device through line 10*a*.

Figure 3:
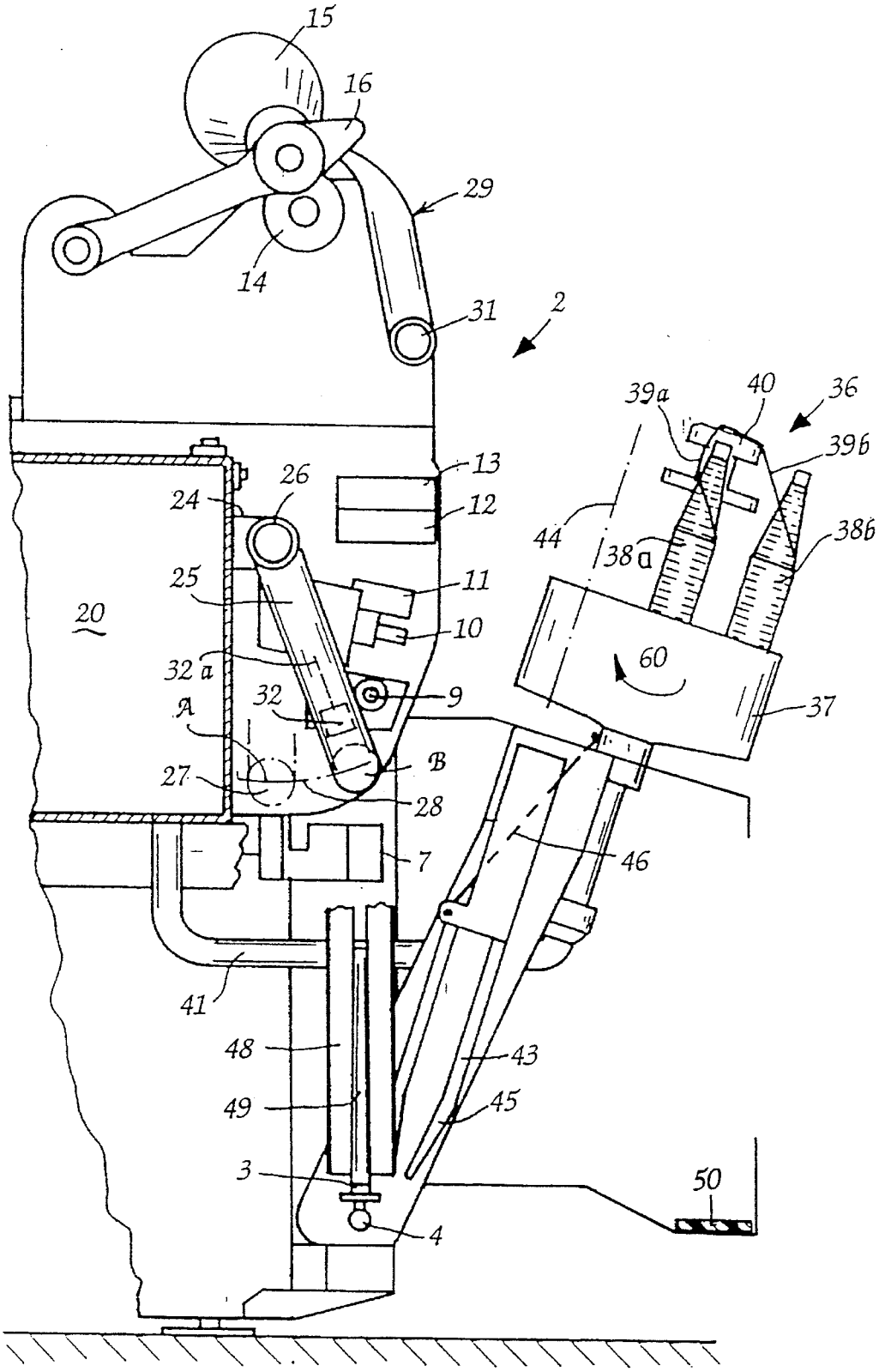
FIG. 3 is a side view of the winding station illustrated in FIG. 1 showing an empty delivery bobbin.

Operation of the present invention according to the preferred embodiment thereof is basically as follows. With reference to FIG. 3, the winding station is illustrated with no delivery bobbin in place and a reserve of bobbins awaiting the unwinding operation in the magazine 37. With reference to FIG. 1, during the unwinding operation, a continuous yarn travel occurs in a predetermine yarn travel direction from the delivery bobbin 5 to the take-up bobbin 15. With no delivery bobbin in place, the electronic cleaner 12 reports the absence of yarn to the control unit 52 using signal line 12*a*. Over signal line 9*a*, the yarn tension device 9 has been closed, in order to retain any possible yarn that may be present downstream of the electronic cleaner 12. Due to the absence of yarn, the yarn manipulator device drive motor 55 is activated via signal line 55*a* by the central control unit 52 o drive the yarn manipulating device 25 through the yarn engagement region. At rest, the yarn manipulating tube 25 normally is directed vertically downwardly, its nozzle 27 being disposed at position A in FIG. 3. Once the motor 55 is actuated, the nozzle 25 is moved to position B which is in the yarn travel path. The yarn tension device 9 is then opened, while, simultaneously, suction is applied at the nozzle 27 to determine whether, indeed, a yarn end is present downstream of the electronic cleaner 12. If a yarn end is engaged by the yarn manipulating tube and detected by the sensor 32 disposed therein, and if the central control unit 52 receives a signal indicating the presence of a yarn end over signal line 32*a* then the yarn manipulating device 25 is pivoted into a position herein the engaged yarn end is placed in the yarn end joining device 10 and the severing and clamping device 11 upstream thereof.

Figure 4:
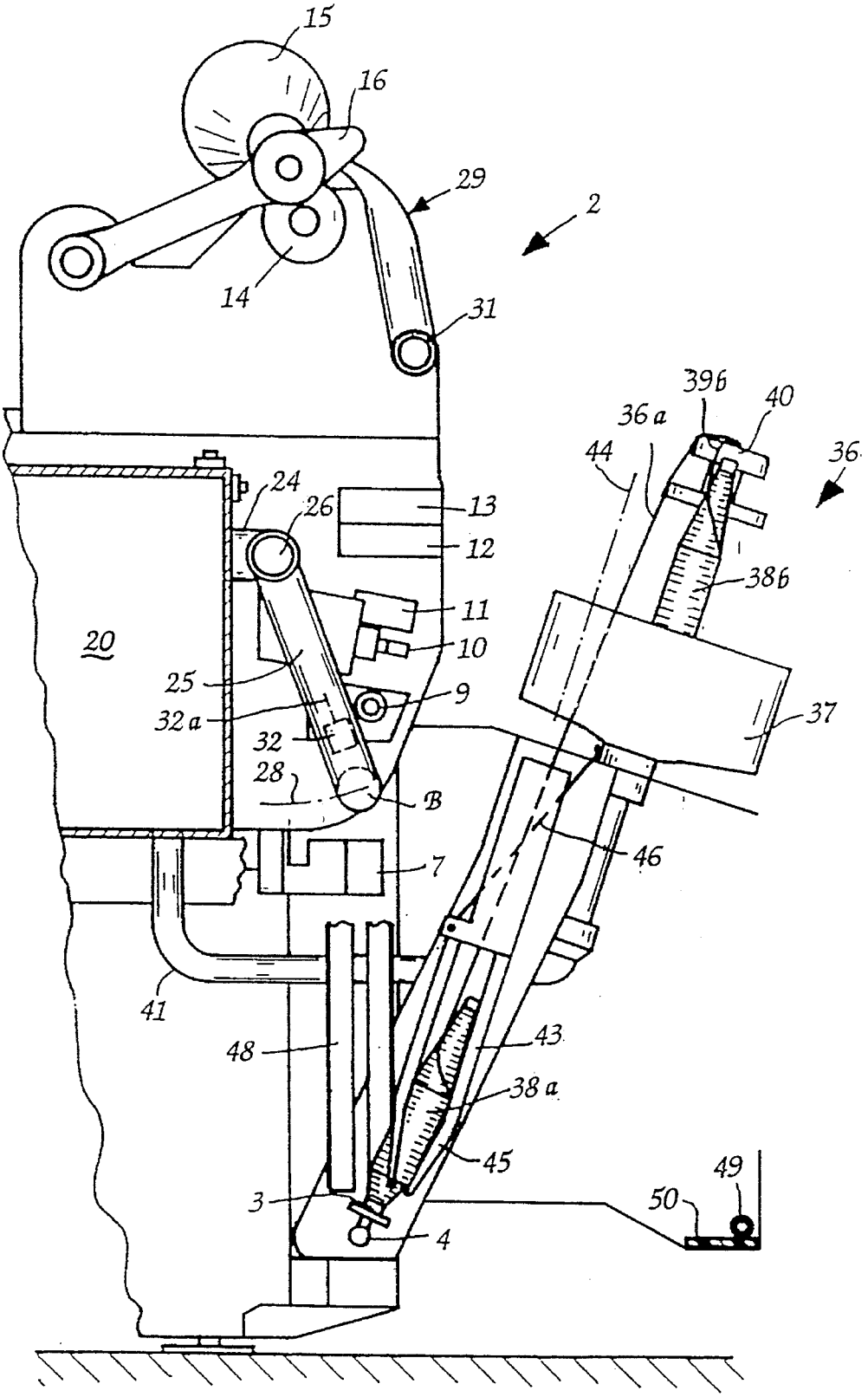
FIG. 4 is a side view of the winding station illustrated in FIG. 3 showing a change of delivery bobbins.

If the yarn downstream of the yarn tension device 9 has broken, and if, with the aid of the blower bottle 48 the yarn end cannot be brought into the yarn engagement region of the nozzle 27 at position B, then no yarn is sensed by the sensor 32. After a predetermined waiting period, it is decided by the central control unit 52 that the delivery bobbin has become empty, and only an empty bobbin tube 49 is disposed on the spindle 3. Accordingly, the empty bobbin tube 49 is ejected and a delivery bobbin 38*a*, ready in the magazine 37 must be moved into unwinding disposition. To that end, the magazine 37 is rotated into a position wherein the next available delivery bobbin 38*a* is ready to load in the winding station 2. This position is shown in FIG. 3 as dotted line 44. The spindle 3 is tilted into receiving position and the alignment flaps 45 are open. With reference to FIG. 4, the new delivery bobbin 38*a* is shown positioned on the spindle with its yarn end 39*a* extending upwardly to the suction nozzle 40 within the bobbin changer device 36.

Figure 5:
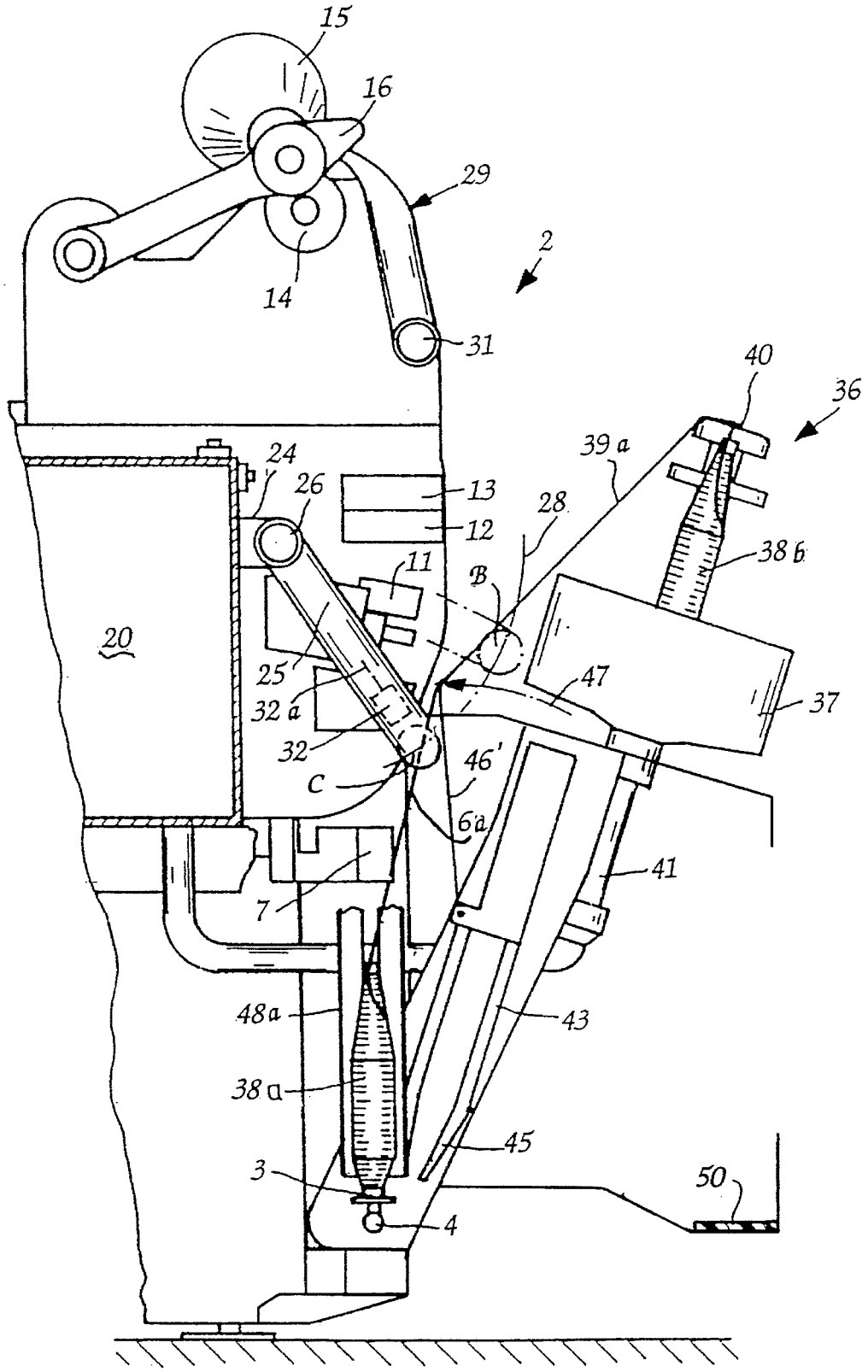
FIG. 5 is a side view of the winding station illustrated in FIG. 4 showing the transfer of yarn to the yarn manipulating device according to the preferred embodiment of the present invention.

With reference to FIG. 5, the full delivery bobbin 38*a* disposed on the spindle 21 is pivoted into unwinding position and the yarn transfer member 46 is caused to pivot through its arc 47, thereby positioning the yarn 39*a* from new delivery bobbin 38*a* within the yarn engagement region along arc 28 of the yarn manipulating device 25 at a position illustrated at 46'. While the yarn transfer member 46 is in motion, the nozzle 27 of the yarn manipulating device is moved through the yarn engagement region to a position C. The nozzle 27 is then disposed adjacent the yarn which now extends from the suction clamp 40 to the delivery bobbin 38*a* in engagement with the yarn transfer member 46.

Two options now exist for further transfer of the lower yarn portion 6*a* from the delivery bobbin 38*a*. The yarn may now be positioned in pneumatically or mechanically. For pneumatic positioning, the yarn end 6*a* is engaged by the suction nozzle 27 of the yarn manipulating device 25 which is moved through arc 28 to place the yarn end 6*a* in the yarn end joining device 10 and the severing and clamping device 11, as well as in the electronic cleaner 12 and its associated severing and clamping device 13. Therefore, retaining and moving of the yarn end 6*a* takes place pneumatically.

In the embodiment illustrated in the accompanying drawings, transfer of the yarn takes place mechanically with no suction required for transfer. There, and with reference to FIG. 5, the yarn manipulating device 25 is moved through its arc 28 to a position D. From this position, a portion of the yarn 39*a* is grasped between the clamping nozzle 40 and the yarn transfer member 46 by mechanical contact with the backside of the suction nozzle 27. To that end, the course of the yarn 39*a* from the suction clamp 40 deviates from the normal yarn path between the yarn transfer member 46 and the suction clamp 40 and is directed into the yarn engagement region of the suction nozzle 27 of the yarn manipulating device 25. The yarn manipulating device 25 is then pivoted further along its arc 28 and the yarn is then put into the normal yarn path and, in the process, placed into the aforesaid devices along the yarn path.

Figure 6:
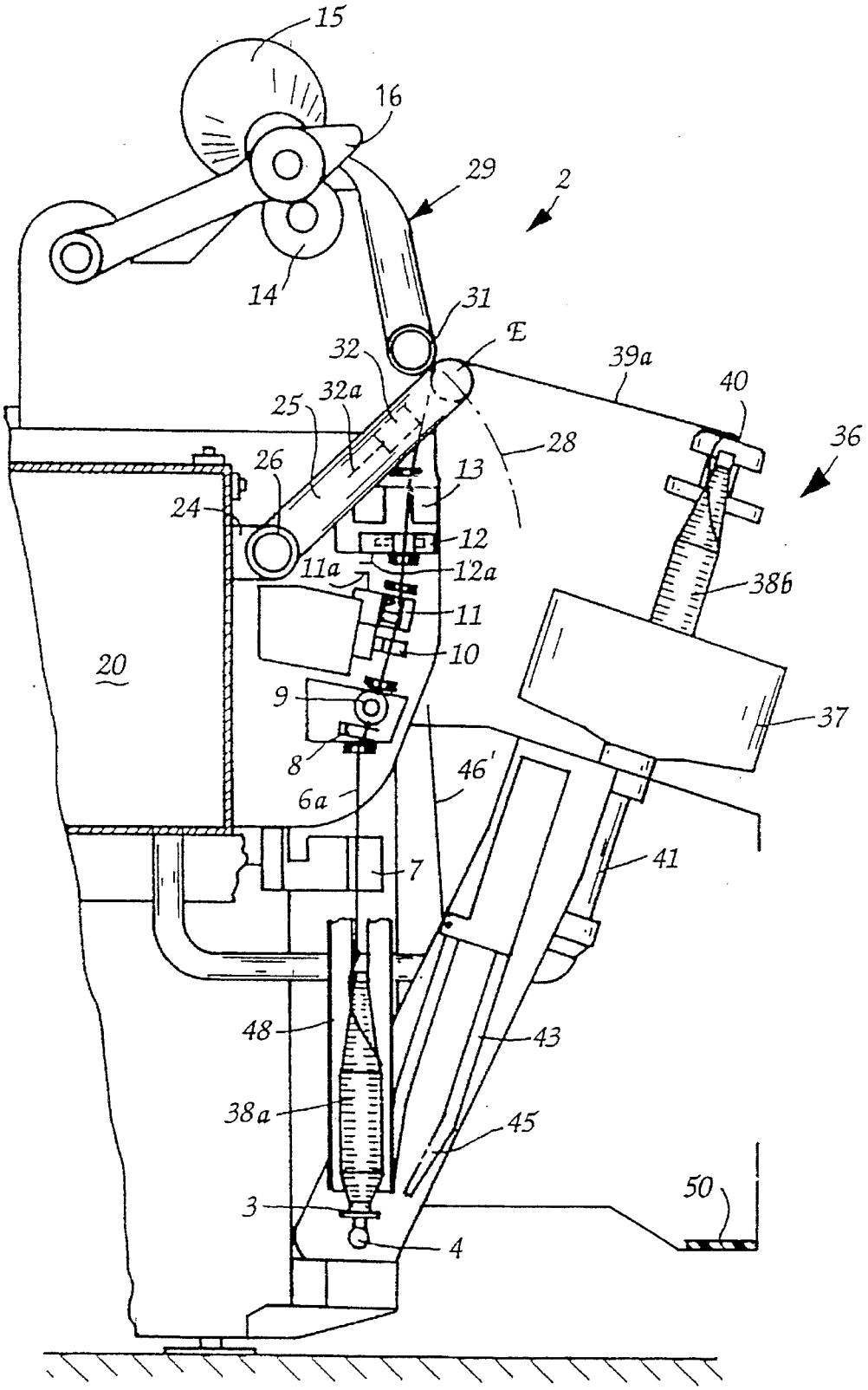
FIG. 6 is a side view of the winding station illustrated in FIG. 5 showing the placing of a yarn end in the cutting and clamping device upstream of the yarn end joining device.

With reference to FIG. 6, the suction nozzle 27 of the yarn manipulating device 25 is moved to position E. There, it is disposed immediately adjacent, but not in contact with, the connector neck 31 of the second nozzle 29. By this movement, the yarn extending between the suction clamp 40 and the delivery bobbin 30*a* is moved as a downstream yarn 6*a* into engagement with the precleaner 8, the opened yarn tension device 9, the yarn end joining device 10, the severing and clamping device 11 upstream of the yarn end joining device 10, the electronic cleaner 12 and the severing and clamping device 13 associated with the electronic cleaner 12. The electronic cleaner 12 then detects the placed downstream yarn 6*a* and reports this finding to the central control device 52, as seen in FIG. 2, through signal line 12*a*. The central control device 52 then activates the downstream severing and clamping device 11 to clamp the placed yarn 6*a* above the yarn end joining device 10 and sever the yarn upstream of the clamping point. Simultaneously, the suction clamp 40 is opened and the severed piece of yarn is removed by the associated suction.

Turning now to FIG. 7, with the downstream yarn clamped in a yarn joining disposition, the yarn manipulating device 25 then is moved into position adjacent the connecting neck 31 of the second nozzle 29 for engagement and retention of the upstream yarn 6*b*. As illustrated herein, the downstream yarn 6*a* has been placed mechanically. Therefore, the suction to the yarn manipulating tube must be activated in order to engage the upstream yarn 6*a*.

As the suction is activated, the winding drum motor 56 is activated by the central control device 52 in an unwinding direction indicated by arrow 61, thereby driving the take-up bobbin in an unwinding direction indicated by arrow 62 so that with the aid of the opening 30 of the second nozzle 29, the end of the yarn located on the circumferential surface of the take-up bobbin 15 is engaged by the second nozzle 29 and, due to the suction applied to the yarn manipulating device 25, the yarn end 6*b* is moved through the second nozzle 29, through the connecting neck 31, and into the yarn manipulating device 25 where its presence is detected by the sensor 32. During this operation, the take-up bobbin 15 is driven further in the direction of arrow 62 to unwind a sufficient amount of yarn for movement by the yarn manipulating device 25.

Once the yarn end 6*b* is detected by the sensor 32, its presence is reported to the central control unit 52 using signal line 32A and the central control device 52 causes the yarn manipulating tube 25 to pivot toward position A through its arc 28 while retaining the yarn end 6*b* by the nozzle 27. As the nozzle 27 moves away from the opening of the connector neck 31, upstream yarn end 6*b* is drawn through the slit 59, as illustrated in FIG. 2, formed in the second nozzle 29, thus placing the yarn 6*b* in the devices disposed along the yarn travel path. Simultaneously, the yarn transfer member 46 is retracted into its rest position.

With reference to FIG. 8, if no upstream yarn is engaged by the yarn manipulating tube 25 as detected by the sensor 32 after a predetermined period of time, then the second nozzle motor 57 is activated by the central control device 52, as previously described, to drive the second nozzle 25 inwardly and outwardly in a reciprocating motion in order to obtain a yarn end from the take-up bobbin 15. As indicated by the double-ended arrow 63, the opening 30 to the second nozzle 29 moves toward and away from the circumferential face of the take-up bobbin 15. This is intended to unwind any loops that may be present and to facilitate the engagement of the yarn end from the surface of the take-up bobbin 15. The number of reciprocation cycles can be specified in advance. Motion therefore continues until a predetermined number of reciprocation cycles have occurred or yarn is detected by the sensor 32 disposed within the yarn manipulating tube 25. If no yarn is detected after a predetermined time period, yarn movement operations are discontinued and a malfunction alarm is activated.

The above-described method with reference to FIGS. 7 and 8, applies to a situation wherein the second nozzle 29 maintains a constant spacing from the circumferential face of the take-up bobbin 15. The growth in diameter of the take-up bobbin 15 must accordingly be set in relation to the position of the second nozzle 29. To this end, a sensor 34 detects the position of the creel 16 which is caused to pivot outwardly as the diameter of the take-up bobbin increases. This sensor 34 may be formed as a potentiometer, providing a voltage signal proportion to creel position therefore proportional to take-up bobbin diameter. The sensor 34 is connected to the central control unit 52 through line 34*a*. Therefore, the position of the creel 16 at any given time is sensed by the central control unit 52, which provides indirect indications as to take-up bobbin diameter. Based on these signals, drive of the second nozzle 29 is controlled by the central control unit 52 such that uniform spacing between the opening 30 of the second nozzle 29 and the circumferential face of the take-up bobbin 15 is maintained.

If automatic control of the spacing of the opening 30 of the second nozzle 29 as previously described is not provided, the second nozzle 29 must be positioned outwardly from the take-up bobbin 15 at a spacing greater than the maximum attainable diameter of the take-up bobbin 15 In order to engage a yarn end from the take-up bobbin 15 the second nozzle 29 must be reciprocated inwardly into contact with the take-up bobbin and then outwardly to its initial position.

Nevertheless, and with reference to FIG. 6, once the upstream yarn end 6*b* has been engaged by the yarn manipulating tube 25, the yarn manipulating tube 25 is caused to pivot downwardly along its arc 28 to a position F adjacent its position of rest in order to place the yarn within the devices along the yarn path. Optionally, a clamping device, not shown here, may be disposed within the yarn manipulating tube 25 so that the yarn may be held and moved without suction being applied, in that case, suction is used only to engage the yarn and the retaining function is performed by the internal clamping element.

Whatever clamping device is employed, as the yarn movement tube 25 is moved downwardly toward position F, the upstream yarn 6*b* is placed in the upstream severing and clamping device 13, the electronic cleaner 12, and the yarn end joining device 10 in a yarn joining disposition. To enhance yarn separation, the yarn tension device 9 remains closed, and the yarn is carried to the side next to the yarn tension device 9 and the precleaner 8. The upstream yarn 6*b* is then detected by the electronic cleaner 12 and its presence is reported to the central control unit 52. As a result, the yarn joining device 10 is activated and the yarn ends are prepared for splicing in a known manner. Simultaneously, the central control unit 52 opens the downstream yarn severing and clamping device 11. The portion of the upstream yarn 6*b* extending from the yarn end joining device 10 into the yarn moving tube 25 severed and removed by suction. The yarns are then spliced in a known manner by a yarn joining device 10.

After termination of the splicing operation, yarn travel between the delivery bobbin 38*a* and the take-up bobbin 15 is established, and the central control unit 52 that activates the winding drum 14 for the resumption of the unwinding operation. The yarn movement tube is then moved to position A to await the next yarn splicing operation.

A final problem may still exist during the yarn splicing operation. Because the upstream yarn and the downstream yarn, although separated, are still located closely adjacent one another in the yarn end joining device 10, the severed free end of the upstream yarn may loop around the bottom yarn after the yarn severing device is actuated. To avoid this problem, after placement of the upstream yarn 6*b* in the yarn end joining device 10 and after clamping thereof, to provide for pivoting of the yarn manipulating device 25 along its arc 28 to a position G in which the yarn end engaged by the yarn manipulating device 25 is positioned upstream of the yarn tension device 9. As a result, the part of the yarn to be severed is held below the yarn end joining device 10 outside the range of the yarn tension device 9 and precleaner 8 until such time as it has been severed and drawn into the yarn manipulating device 25 by suction. Thereafter, the yarn manipulating device 25 is pivoted back to its inoperative position A.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a winding station of a bobbin winding machine having at least one delivery bobbin having a delivery yarn end, at least one take-up bobbin having a take-up yarn end, and a yarn joining device, a method for moving the individual yarn ends into yarn receiving disposition at the yarn joining device for subsequent joining thereof, said method comprising the steps of:

providing a singular yarn manipulating device for moving both the delivery yarn end and the take-up yarn end;

moving a first one of the yarn ends into yarn receiving disposition at the yarn joining device using said yarn manipulating device; and moving a second one of the yarn ends into yarn receiving disposition at the yarn joining device using said yarn manipulating device after said first yarn end is disposed at the yarn joining device for subsequent joining of the yarn ends.

2. A method for moving individual yarn ends into a yarn joining disposition according to claim 1 wherein the step of moving a first yarn end includes first sensing the presence of a yarn end within the yarn manipulating device and maintaining said sensing until said first yarn end is disposed in yarn receiving disposition at the yarn end joining device and the step of moving a second yarn end includes first sensing the presence of a yarn end within the yarn manipulating device and maintaining said sensing until the second yarn end is disposed in yarn receiving disposition at the yarn joining device.

3. A method for moving individual yarn ends into a yarn joining disposition according to claim 1 wherein the yarn travels from the delivery bobbin to the take-up bobbin in a predetermined travel direction, the step of moving the delivery yarn end occurs prior to the step of moving the take-up yarn end, and the step of moving the delivery yarn end includes the steps of engaging the delivery yarn end with the yarn manipulating device at a first predetermined position of the yarn manipulating device; moving the yarn manipulating device along with the delivery yarn end to a second predetermined position; placing the delivery yarn end into the yarn joining device; clamping the delivery yarn end upstream of the yarn end joining device in the yarn travel direction; and severing the yarn upstream from the clamped yarn, and the step of moving the take-up yarn end includes the steps of engaging the take-up yarn end with the yarn manipulating device at said second predetermined position; placing said take-up yarn end into the yarn joining device while moving said yarn manipulating device to said first predetermined position.

4. A method for moving individual yarn ends into a yarn joining disposition according to claim 3 and further comprising the initial step of providing a single suction source associated with said yarn manipulating device for use on both the delivery yarn end and the take-up yarn end; the steps of engaging the delivery yarn end and placing the delivery yarn end in the yarn joining device are performed by the suction source and the steps of engaging the take-up yarn end and placing the take-up yarn end in the yarn end joining device are performed by the suction source.

5. In a winding station of a bobbin winding machine having at least one delivery bobbin having a yarn end, at least one take-up bobbin having a yarn end, and a yarn joining device, an apparatus for moving the individual yarn ends into yarn receiving disposition in the yarn joining device for subsequent joining thereof, said apparatus comprising a singular yarn manipulating device for moving individually and in succession a first one of the yarn ends into yarn receiving disposition at the yarn joining device and then a second one of the yarn ends into yarn receiving disposition at the yarn joining device.

6. An apparatus for moving individual yarn ends into a yarn joining disposition according to claim 5 wherein said yarn manipulating device has a pivotably mounted portion and including means for applying suction for aspiration of the yarn ends.

7. An apparatus for moving individual yarn ends into a yarn joining disposition according to claim 6 wherein said yarn manipulating device includes a first suction nozzle pivotably mounted at one end for movement through a yarn end transfer path, and said apparatus further comprises a second suction nozzle disposed adjacent the take-up bobbin for aspiration of a yarn end from the take-up bobbin, said first suction nozzle and said second nozzle being cooperatively arranged for transfer of the take-up bobbin yarn end from the second nozzle to the first suction nozzle for aspiration and subsequent movement thereby to the yarn joining device.

8. An apparatus for moving individual yarn ends into a yarn joining disposition according to claim 7 wherein said first suction nozzle is pivotable through a plane through which the yarn travels, and said second suction nozzle includes a generally flat opening disposed adjacent the circumferential face of the take-up bobbin and has a connection neck disposed at its opposite end for cooperative engagement with said first suction nozzle for suction aspiration of the take-up bobbin yarn end.

9. An apparatus for moving individual yarn ends into a yarn joining disposition according to claim 6 wherein said second suction nozzle is pivotably mounted for movement toward and away from the take-up bobbin, and said apparatus further comprises means for moving said second suction nozzle, and means for controlling said second suction nozzle movement.

10. An apparatus for moving individual yarn ends into a yarn joining disposition according to claim 7 and further comprising means for sensing the presence of a yarn end in the yarn manipulating device.

11. An apparatus for moving individual yarn ends into a yarn joining disposition according to claim 7 wherein the yarn travels from the delivery bobbin to the take-up bobbin in a predetermined yarn travel direction and the winding machine includes means for clamping and severing yarn, said clamping and severing means being disposed upstream of the yarn end joining device and actuable independently of the yarn end joining device, and said apparatus further comprises means for pivotally moving said suction nozzle of said yarn manipulating device through said yarn transfer path and control means for selectively controlling the operation of said drive means, said suction nozzle of said yarn manipulating device being movable in said yarn transfer path between an initial position upstream of the delivery bobbin and a final position adjacent said second nozzle, said control means being operative to move said suction nozzle from its initial position to a first yarn receiving position for aspiration of the yarn end from the delivery bobbin, therefrom to a second position adjacent the yarn end joining device for placement of the delivery bobbin yarn end into the yarn end joining device, therefrom to a third yarn receiving position at said second nozzle for aspiration of the yarn end from the take-up bobbin, and therefrom to the initial position of the suction nozzle for placement of the take-up bobbin yarn end into the yarn end joining device for subsequent joining of the yarn ends by the yarn end joining device, said control means being further operative to actuate said clamping and severing means for clamping and severing said delivery bobbin yarn end after movement of the suction nozzle of the yarn manipulating device from its initial position to its second position.

12. An apparatus for moving individual yarn ends into a yarn joining disposition according to claim 11 wherein said apparatus further comprises means for sensing the presence of a yarn end in said yarn manipulating device and said means for controlling movement of said second suction nozzle is operatively connected to said sensing means to actuate said means for moving said second suction nozzle in response to said sensing means indicating the absence of a yarn end in said yarn manipulating device.

13. An apparatus for moving individual yarn ends into a yarn joining disposition according to claim 7 wherein said second suction nozzle includes a slot for passage therethrough of a yarn end from the take-up bobbin upon placement of the yarn end in the yarn end joining device, said slot being disposed adjacent the take-up bobbin.

14. An apparatus for moving individual yarn ends into a yarn joining disposition according to claim 13 further comprising means for controlling said second nozzle and means for determining the instantaneous diameter of the take-up bobbin, said diameter determining means being operatively connected to said second nozzle control means for initiating movement of said second suction nozzle responsive to changes in diameter of said take-up bobbin for maintaining a predetermined spacing between said second suction nozzle and said take-up bobbin.

15. An apparatus for moving individual yarn ends into a yarn joining disposition according to claim 6 and further comprising means disposed in the suction applying means for detecting the presence of an aspirated yarn end.

* * * * *